US006817385B1

(12) United States Patent
Sloan et al.

(10) Patent No.: US 6,817,385 B1
(45) Date of Patent: Nov. 16, 2004

(54) METHOD AND APPARATUS FOR FILLING A LIQUID CONTAINER AND CONVERTING LIQUID PHASE FLUID INTO A GASEOUS PHASE FOR DISPENSING TO USERS

(75) Inventors: Jeffrey E. Sloan, Bonita, CA (US); Eugene L. Bellegarde, San Diego, CA (US)

(73) Assignee: VA-Tran Systems Inc., Chula Vista, CA (US)

( * ) Notice: Subject to any disclaimer, the term of this patent is extended or adjusted under 35 U.S.C. 154(b) by 0 days.

(21) Appl. No.: 10/368,255

(22) Filed: Feb. 15, 2003

(51) Int. Cl.[7] ..... B65B 1/04

(52) U.S. Cl. ..... 141/3; 141/44; 141/99; 141/236; 141/237; 141/285; 141/302; 137/885

(58) Field of Search ..... 141/3, 44, 46, 141/50, 54, 55, 99, 100, 102, 236, 237, 285, 286, 301, 302; 137/884, 885, 872

(56) References Cited

U.S. PATENT DOCUMENTS

| | | | | |
|---|---|---|---|---|
| 2,412,613 A | | 12/1946 | Grant, Jr. | |
| 2,492,165 A | | 12/1949 | Mapes | |
| 2,591,641 A | | 4/1952 | Tiroendle | |
| 2,916,061 A | * | 12/1959 | Hahn et al. | 141/349 |
| 3,018,635 A | * | 1/1962 | Keckler | 137/595 |
| 3,712,073 A | * | 1/1973 | Arenson | 62/50.2 |
| 3,760,834 A | | 9/1973 | Shonerd et al. | |
| 4,080,800 A | * | 3/1978 | Spaulding et al. | 137/539.5 |
| 4,887,645 A | * | 12/1989 | Kerger | 137/884 |
| 4,936,343 A | | 6/1990 | Pruitt et al. | |
| 5,088,436 A | * | 2/1992 | Stritmatter | 141/3 |
| 5,113,905 A | | 5/1992 | Pruitt et al. | |
| 6,609,381 B1 | * | 8/2003 | Morgan | 141/83 |

* cited by examiner

*Primary Examiner*—Gregory L. Huson
*Assistant Examiner*—Khoa Huynh
(74) *Attorney, Agent, or Firm*—Michael P. Eddy

(57) ABSTRACT

A method an apparatus for establishing in a system for dispensing fluid in a gaseous phase a predetermined quantify of the fluid in its liquid phase, and for allowing such fluid in its liquid phase to vaporize into its gaseous phase to replace the gaseous phase fluid that is dispensed to users.

20 Claims, 4 Drawing Sheets

PUMP SUPPLY
16
14
P
2
12
2
18
VENT
10
44
R
42
64
G
62
76
TO PROCESS
68
48
72
70
52
52
50

3
10
3
12

METHOD AND APPARATUS FOR FILLING A LIQUID CONTAINER AND CONVERTING LIQUID PHASE FLUID INTO A GASEOUS PHASE FOR DISPENSING TO USERS

BACKGROUND OF THE INVENTION

1. Field of the Invention

This invention relates to a method and apparatus for filling a dispensing system with fluid in its liquid phase, the system enabling the liquid to subsequently vaporize into its gaseous phase for dispensing to users.

2. Description of the Prior Art

It is known to fill a dispensing system with a fluid in its liquid phase, with the system being operative to enable conversion of the fluid to its vapor or gaseous phase for dispensing, such as dispensing gaseous carbon dioxide to a carbonated drink dispenser.

U.S. Pat. No. 4,936,343, dated Jun. 26, 1990 and issued to John E. Pruitt et al, discloses a "Carbon Dioxide Fill Manifold" comprising a manifold having a fill line which accepts fluid in its liquid phase from a storage vehicle or the like for completely filling one or more liquid storage containers to which it is connected, the liquid storage containers in turn being connected in series with one or more gas storage containers.

An atomizer disposed between the liquid and gas storage containers is operative to establish a proper ratio of liquid to gas in the dispensing system.

Each time a user dispenses some of the gas, the gas flows through the atomizer and develops a pressure differential between the liquid and gas storage containers. This differential increases as successive gas withdrawals occur. When a certain level of pressure differential is reached, an in-line pressure relief valve in the system opens to automatically permit additional, make-up liquid to flow through the atomizer and replenish the supply of available gas.

The added liquid vaporizes and expands into gas which fills the gas storage container or containers, according to the existing pressure differential to their original levels. Liquid/vapor flow continues through the atomizer until the requisite pressure differential is no longer present at the in-line relief valve. At that time the valve closes and shuts off further liquid flow. If overfilling occurs, such that some of the liquid flows into the portion of the gas storage container that is reserved for gas expansion, excess pressure can develop. Consequently, each gas storage container is provided with a rupture disc designed to fail when the container pressure exceeds a predetermined level. If overfilling is prohibitively high, the rupture disc fails and the contents of the container are jettisoned.

A similar system that employs a vaporizer or atomizer is disclosed in U.S. Pat. No. 5,113,905, dated May 19, 1992 and issued to Pruitt et al for a "Carbon Dioxide Fill Manifold and Method". The patent is based upon an application which is a continuation-in-part of the application which resulted in issuance of the above-discussed U.S. Pat. No. 4,936,343.

The atomizer of the '905 patent includes an atomizer having a pressure actuated check valve located internally of the atomizer for periodically replenishing the supply of gas in response to the development of a selected pressure differential across the pressure actuated valve.

Various other analogous systems are provided in the prior art for dispensing a gaseous phase of a fluid such as carbon dioxide but many, like the two patents just described, are characterized by special relief valves, pressure actuated valves, vaporizers or the like. That is, a regulator such as a check valve or other pressure responsive device is used between the liquid and gaseous portions of such systems to control the change of liquid to gas. This results in a system that is relatively complex, expensive to maintain, and not as responsive to the needs of users as the method and apparatus of the present invention. As will be seen, in the system of the present invention there is no such regulator. All manifold passages are open and interconnected with no pressure differential between them.

SUMMARY OF THE INVENTION

According to the present invention, a system is provided which is particularly adapted for use as a carbonated beverage dispensing system. The system includes a manifold which can be connected to a supply truck or other source of carbon dioxide fluid in its liquid phase.

The manifold includes a controller in the form of a spool valve which is movable to a closed position by the pumping pressure developed when the liquid is pumped into the manifold from the liquid source. The incoming liquid flows around and through the closed spool valve into liquid passages in the manifold that are connected to a set of liquid storage cylinders. However, the flow of liquid is blocked by the spool valve from flowing into a dispenser passage which leads to the dispensing port through which the gaseous form of the fluid is dispensed to a user. The terms "gas", "gaseous" and "vapor" are sometimes interchangeably used as a matter of convenience.

When the liquid storage cylinders are completely filled in the closed position of the spool valve by the incoming liquid flowing past the spool valve, the pump is turned off. The hose from the filling pump is vented when the pump is turned off, so the manifold pressure exceeds the pressure on the inlet or filling port, and the spool is shifted to its open position. The pump can be turned off manually, or automatically in response to an increase in pressure when the system is full of liquid. The liquid within the liquid storage cylinders is now undergoing vaporization, the rapidity of vaporization depending upon the magnitude of the vapor pressure in the system.

With the spool valve in its open position, fluid communication is provided between all of the manifold passages, i.e. the liquid passages, the gas passages, and the dispensing passage. The evolving gas then can flow through all of these passages and particularly into the gas storage container or containers.

There is no pressure differential between any of these passages. The production of gas can therefore occur without the use of any special vaporizer, atomizer or valving arrangement designed to respond to predetermined pressure differentials or the like to produce gas. The generation of gas automatically continues until the liquid has been substantially all vaporized and the resulting gas completely used. When this fill cycle is completed, and the liquid has been substantially all used, with the pump having been turned off and the spool valve moved to its open position by internal manifold pressure or, as will be seen, by bias means acting against the spool valve, the pump can again be manually turned on and the apparatus operated to initiate another fill/use cycle to introduce a fresh supply of liquid for the manifold from the supply vehicle.

Reference has been made to a spool valve type of controller but, as will be described, there are other types of valving arrangements which can be used, if desired, to provide the described functions of the spool valve.

DESCRIPTION OF THE PREFERRED EMBODIMENTS

Figure 1:
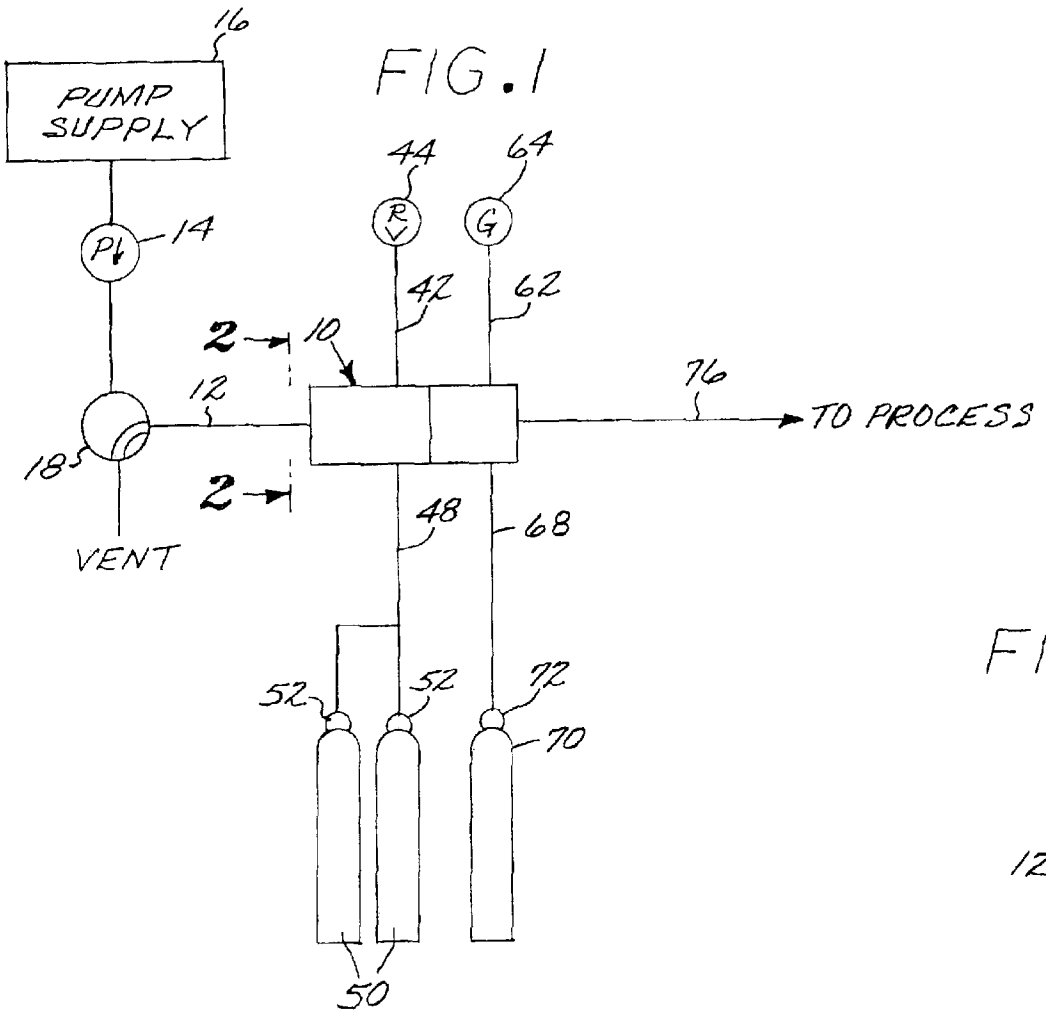
FIG. 1 is a partially schematic view of the system of the present invention.
Figure 2:
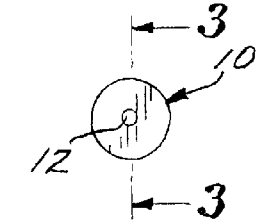
FIG. 2 is a view taken along the line 2—2 of FIG. 1.

Referring now to the drawings, and particularly to FIGS. 1–4, the present apparatus includes a manifold 10 which is connected to a fill conduit 12. The conduit 12 is connected to a pump 14 that is turned on to initiate a fill cycle by supplying fluid in its liquid phase from a pump supply 16 (not shown) that is typically transportable by a supply truck or the like (not shown).

The conduit section between the pump 14 and the manifold 10 includes a vent valve 18 which can be operated to vent the manifold 10 to atmosphere. Once venting is completed the valve 18 is manually rotated counter-clockwise through a ninety (90) degree angle to close off the vent and open a path for liquid from the pump 14 into the fill conduit 12 that extends into the manifold 10.

Various fluids in their liquid phase can be converted in the present apparatus into a vaporous or gaseous phase through atomization, vaporization or the like. Such fluids can be propane, nitrous oxide, and the like, particularly including carbon dioxide which, in the present apparatus, is enabled to evolve from its liquid phase to its vaporous or gaseous phase, usually hereinafter referred to as "gas". In this gaseous form the carbon dioxide is discharged for use in a carbonated beverage machine (not shown).

With the vent valve 18 in its counterclockwise position, the pump 14 can be turned on, and the pumped liquid carbon dioxide passed into the fill conduit 12 through a flexible hose (not shown) which may be adapted for quick connection and disconnection at the fill site. Once the pumped liquid fills the liquid storage or receiver portions of the manifold system, the pump is shut off, the supply line is vented, and the manifold disconnected from the supply truck. In typical circumstances the truck leaves on its delivery route and returns, as needed, with a fresh supply of liquid carbon dioxide. Other liquid supply arrangements can be provided, as desired.

As is well known in the prior art, the liquid receivers or storage containers are completely filled, but there are vapor or gas receivers which are provided in the system that are empty. The accepted arrangement is to provide one or more ballast or gas storage receivers or containers having space sufficient for the liquid carbon dioxide to vaporize. A typical ratio is to provide approximately one vapor or gas container for every two liquid storage containers.

The manifold 10 within which vaporization occurs comprises an elongated body having a liquid supply passage 22 that is characterized by a threaded upstream portion adapted to threadably receive a threaded fitting at the end of the flexible hose or fill conduit 12 that is connected to the pump supply 16. Downstream of the threaded portion, the passage 22 includes an upstream portion 24, an intermediate diameter portion 28 having a diameter greater than the upstream portion 24, and a larger downstream portion 26.

The differences in diameter between the portions 24 and 28 forms a circumferentially extending shoulder or seat 30 which serves as a stop to limit the upstream movement of the controller or spool valve 32 within the liquid supply passage 22.

The downstream extremity of the spool valve 32 includes a circumferentially extending shoulder 34 reciprocally movable within the downstream portion 26 of the supply passage 22. Its upstream travel is limited by engagement with a leak age seal or O-ring 36 seated within a complemental circumferential groove provided at the juncture of the downstream portion 26 and the intermediate portion 28.

The downstream portion 26 of the liquid supply passage 22 opens into a manifold space or liquid receiver 38 having outwardly directed passages, one of which can be a relief valve passage 40 connected by a conduit 42 to a relief valve 44, as best seen in FIG. 1. The opposite passage is a liquid passage 46 connected by a conduit 48 to one or more liquid containers 50 which serve as extensions of the liquid receiver 38. Such containers 50 each are associated with or mount a valve 52 for manually closing and opening the liquid containers 50.

The manifold 10 is formed in two parts, an upstream portion and a downstream portion which are joined in fluid sealing relation. The upstream portion contains the liquid receiver 38, and the downstream portion contains an internal gas receiver 54. The receivers 38 and 54 are coupled together by an interconnecting passage 56 in the manifold 10.

The passage 56 includes a stop or seat which closely accepts in sealed relation a downstream valve extremity 58 of the valve 32. This seating of the extremity 58 occurs to define the closed status of the manifold illustrated in FIG. 4.

Figure 3:
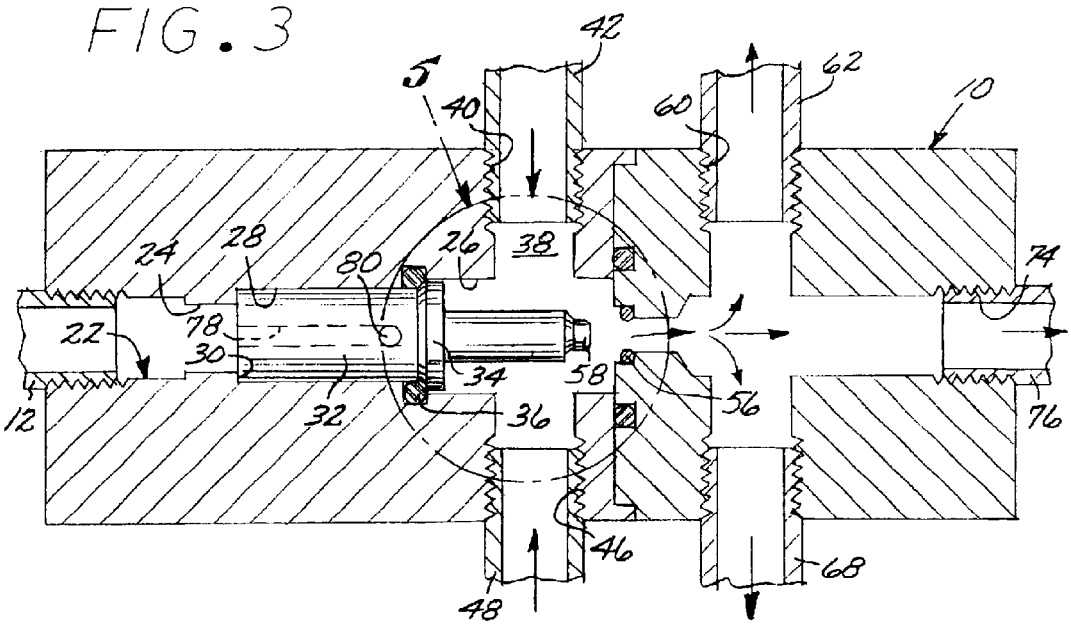
FIG. 3 is a longitudinal cross sectional view of the manifold of the system taken along the line 3—3 of FIG. 2, the spool valve being illustrated in its open position, with the use port open and the system in its use mode for dispensing gas to an end user.

Cessation of flow from the pump causes movement of the valve 32 in an upstream direction, which unseats the valve extremity 58. This opens the interconnecting passage 56, and simultaneously causes the valve shoulder 34 to seat upon the O-ring 36 in sealing relation and blocks returning flow of liquid through the liquid supply passage 22, as illustrated in FIG. 3.

The portion of the manifold 10 containing the internal space or gas receiver 54 also includes outwardly directed passages which extend out of the gas receiver 54. One of these passages is a pressure gauge passage 60 which threadably receives a conduit 62 that is connected to a pressure gauge 64. The other of the passages is a gas passage 66 which threadably receives a conduit 68 that is connected to a ballast tank or gas container 70 which forms part of the gas receiver means 54. If desired, the conduit 68 may include a pressure gauge 72 for determining the pressure in the container 70.

The downstream extremity of the manifold 10 also includes a gas dispensing passage 74 which extends out of the gas receiver means 54 for threadably receiving a conduit 76 whose opposite end is adapted for connection to a dispensing apparatus such as a carbonated beverage dispensing machine (not shown).

Figure 4:
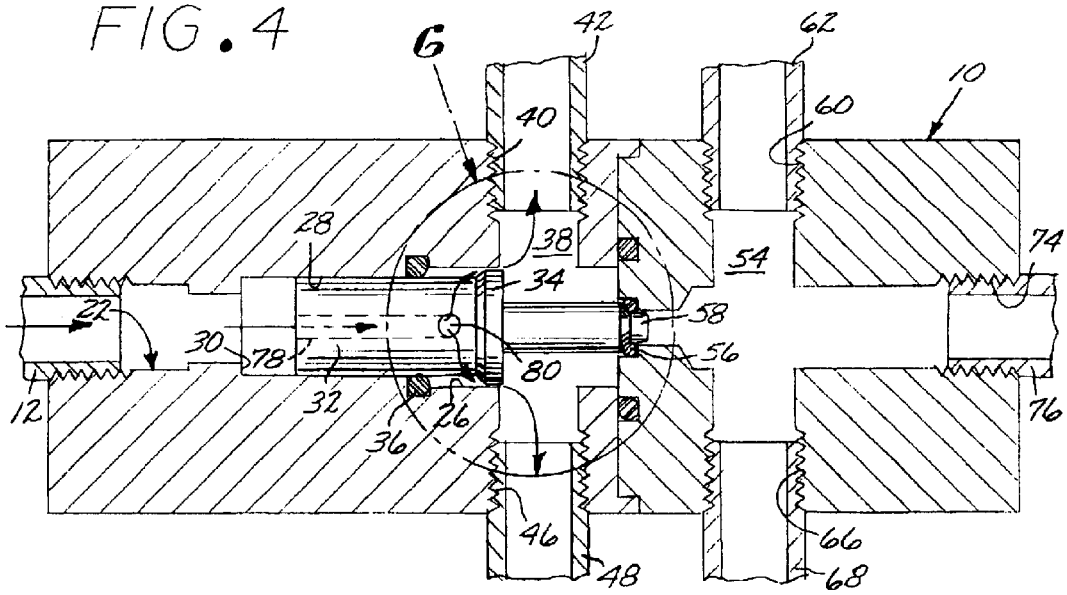
FIG. 4 is a longitudinal cross sectional view similar to FIG. 3 except that the spool valve is illustrated in its closed position in which the use port is closed and the system is in its fill mode for receiving incoming liquid.

In operation, the valve 32 is in the closed position illustrated in FIG. 4. An operator operates the filling pump 14 to pump liquid carbon dioxide from the pump supply 16 and into the fill conduit 12. There is a clearance or annular space between the adjacent cylindrical surfaces of the intermediate portion 28 of the liquid supply passage 22 and the valve 32. A similar annular space is defined between the adjacent cylindrical surfaces of the valve shoulder 34 and the downstream portion 26 of the passage 22.

In addition, the valve 32 includes an axial passage 78 which extends longitudinally from the upper surface of the valve 32 to a point just above the shoulder 34 of the valve 32. At that point a passage 80 extends transversely through the upper portion of the valve 32 to provide fluid communication between the axial passage 78 and the annular space formed between the valve 32 and the larger diameter cylindrical wall of the downstream portion 26 of the valve 32.

The liquid carbon dioxide being pumped into the liquid supply passage 22 at this time can thus flow around and through the valve 32, into the liquid receiver 38, into the relief valve conduit 42 and into the liquid passage conduit 48. However, there is no flow of liquid into the gas receiver 54 because the downstream extremity 58 of the valve 32 is seated against the 0-ring mounted within the adjacent end of the interconnecting passage 56.

Liquid flow into the liquid receiver 38 continues until liquid fills all of the liquid containers 50 forming part of the manifold liquid receiver 38.

When liquid completely fills the liquid receiver 38, the operator shuts off the pump 14. The operator next opens the valve 18 to vent the fill manifold 10.

At this time the internal pressure within the liquid receiver 38 moves the valve 32 to its open position, as seen in FIG. 3. In some applications the internal pressure may not be sufficient to rapidly move the valve 32 to its open position, which is important to prevent reverse flow of liquid from the liquid supply passage 22. For that reason, the compression spring 82 illustrated in the embodiment of FIG. 5 can be provided to insure movement of the valve 32 into its closed position.

Figure 5:
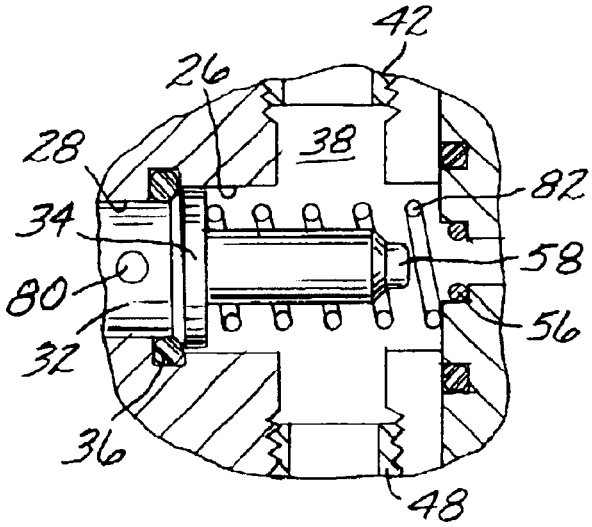
FIG. 5 is a detail view in the area designated by the numeral 5 in FIG. 3, showing an embodiment of the invention in which a bias means in the form of a spring in its uncompressed state is disposed between the spool valve and the manifold adjacent the use port.
Figure 6:
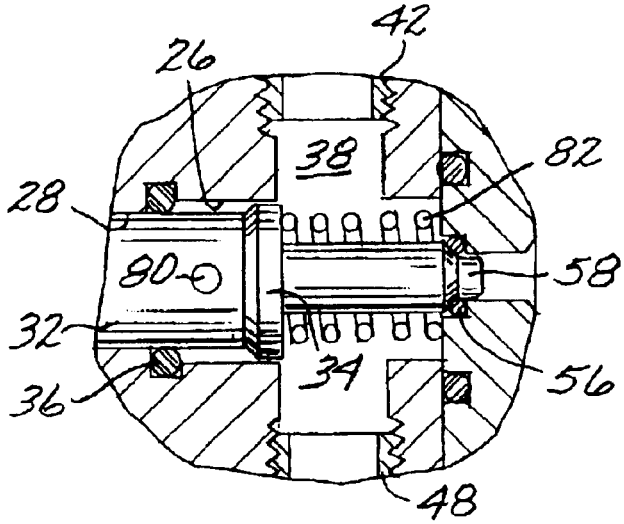
FIG. 6 is a detail view in the area designated by the numeral 6 in FIG. 4, similar to FIG. 5, but showing an embodiment of the invention in which the bias means is in its compressed state to bias the spool valve from its open position of FIG.3 toward its closed position of FIG. 4.

Referring now to FIG. 5, the compression spring 82 is shown in its uncompressed state corresponding to the open state of the apparatus shown in the corresponding FIG. 3. Likewise, in FIG. 6, the compression spring 82 is illustrated in its compressed state corresponding to the closed state of the apparatus illustrated in FIG. 4. In this state the spring 82 exerts a bias against the valve 32 which desirably tends to move the valve 32 to the position of FIG. 3 in the absence of pump pressure.

The liquid in the manifold portion of the receiver 38 now can flow into the gauge passage 60 and into the gas passage 66. Its vapor pressure causes a portion of the liquid to vaporize, and evolving gas can then fill the gauge passage 60, the gas passage 66, and the gas dispensing passage 74, enabling its dispensation to a user operating the usual valve arrangement common in dispensing systems (not shown).

At this time all spaces comprising any part of the liquid receiver 38 and the gas receiver 54 are at the same pressure. This enables replacement gas to evolve freely, automatically, and continuously through vaporization of the of the liquid in the system, contemporaneously with consumption of gas dispensed to the end user. There is no need for the existence of differential pressures to trigger regulating devices to vaporize the liquid carbon dioxide.

When the liquid in the system is completely consumed, the operator can simply turn on the pump 14 again until the liquid receiver 38, including the liquid containers 50, is filled, and the previously described cycle of venting through the valve 18, and filling and dispensing.

Other valves may be used to change the apparatus from its closed state to its open state, and vice versa. One example is a valve identified as a PD10-40 marketed by Hydra Force, Inc., 500 Barclay Boulevard, Lincolnshire, Ill. 60069-4306. It is merely exemplary of one form of externally piloted three way valve that can be used. Any form of three way valve that can be externally piloted can be used, such as ball or needle valves, for example, but not by way of limitation. Where possible, numerals with the subscript "a" have been used to designate components of the valve comparable to components of the valve 32 which are generally similar.

Figure 7:
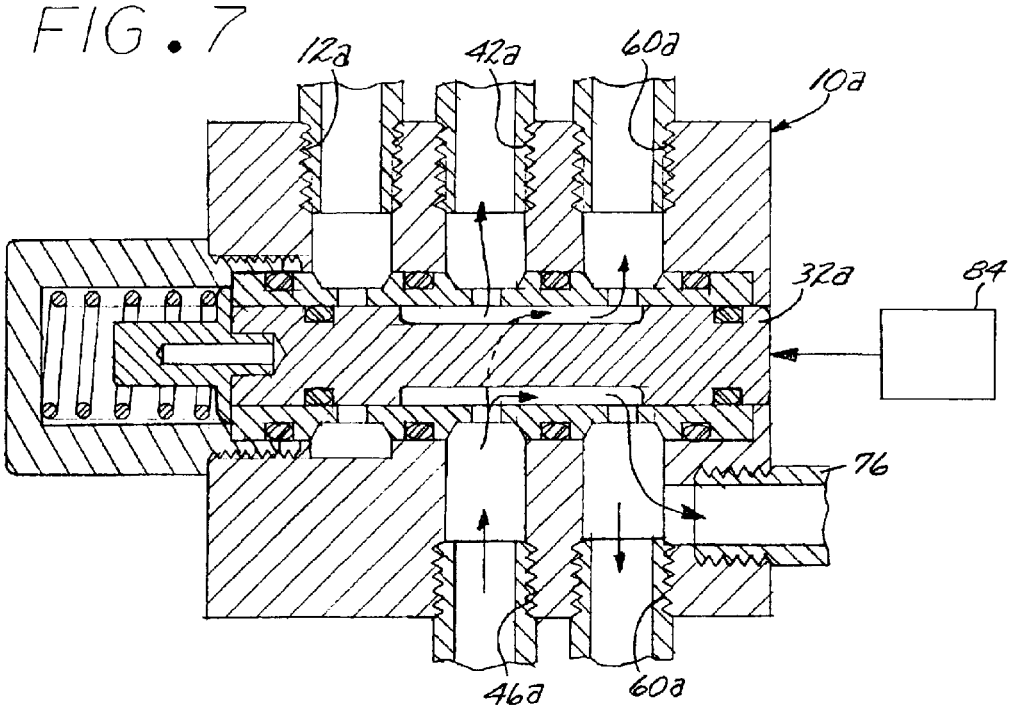
FIG. 7 is a diagrammatic showing of a commercially available three way valve that can be substituted for the spool valve of FIGS. 1–5, the valve being illustrated in a position which places the apparatus in the open state illustrated in FIG. 3.
Figure 8:
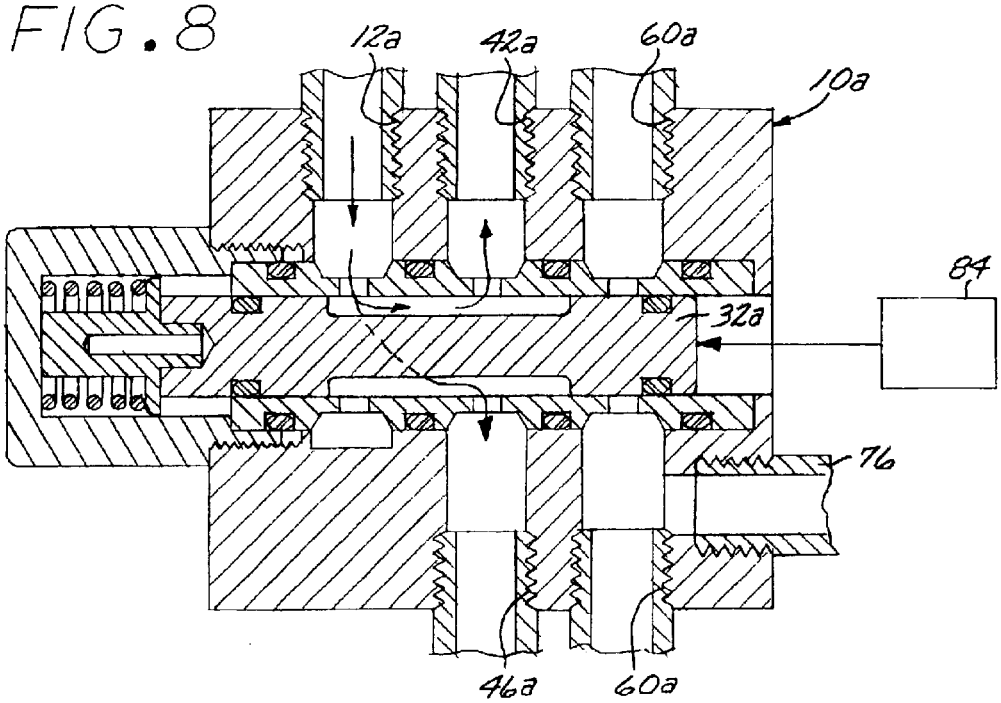
FIG. 8 is a diagrammatic showing similar to the showing of FIG. 7, but illustrating actuation of the piston of the valve to the left, placing the apparatus in the closed state illustrated in FIG. 4.

FIG. 7 is a longitudinal cross sectional view of such a valve 32*a*having a suitably vented manifold 62*a*with passageways corresponding to the passageways of the embodiment of FIGS. 3 and 4. However, the valve 32*a*is moved, not by pump pressure as in the first embodiment, but by a compressed air system 84 shown schematically as positioned to act against an end of the valve 32*a*to move it inwardly from the open state of FIG. 3 to the closed state of FIG. 4 in which liquid under pump pressure flows into the fill conduit 12*a*, through an annular passage on the exterior of the valve 32*a*, and into the relief valve conduit 42*a*and the liquid conduit 48, but not into any of the gas passages. When air pressure is not applied, the valve 32*a*is biased to move to the right to the open state of FIG. 3, in which further liquid cannot enter through the fill conduit 12*a*, but evolved gas can flow into all passages, including relief valve passage 42*a*, liquid passage 46*a*, pressure gauge passage 60*a*, gas passage 66*a*, and gas dispensing passage 74.

As will be apparent, the operative characteristics correspond with the embodiment of FIGS. 3 and 4, which is characterized by the aforementioned existence of the same pressure in all parts of the liquid and gas receiver portions of the apparatus, enabling replacement gas to evolve freely, automatically, and continuously through vaporization of the of the liquid in the system, contemporaneously with consumption of gas dispensed to the end user. There is no need for the existence of differential pressures to trigger regulating devices to vaporize the liquid carbon dioxide.

While several forms of the invention have been illustrated and described, it will be apparent that various modifications can be made without departing from the spirit and scope of the invention.

What is claimed is:

1. A method for filling a liquid storage system and converting the liquid phase of a fluid into its gaseous phase and dispensing the gas to users, the method comprising the steps of:

providing a gaseous phase receiver means and a liquid phase receiver means;

introducing a flow of the liquid phase fluid into the liquid phase receiver means;

blocking flow of the liquid phase fluid into the gaseous phase receiver means;

blocking flow of the liquid phase fluid into the liquid phase receiver means when the liquid phase receiver means is substantially filled;

blocking the exit of liquid phase fluid from the system;

providing intercommunication between the gaseous phase receiver means and the liquid phase receiver means when the liquid phase receiver means is substantially filled with liquid phase fluid thereby to prevent establishment of any pressure differential between the gaseous phase receiver means and the liquid phase receiver means, and thereby enable free flow of the gaseous phase fluid throughout the liquid phase receiver means and the gaseous phase receiver means;

allowing the liquid phase fluid to vaporize throughout the liquid phase receiver means and the gaseous phase receiver means and thereby form gaseous phase fluid sufficient to substantially fill the gaseous phase receiver means; and allowing a controlled flow of the gaseous phase fluid out of the gaseous phase receiver means under the control of an end user.

2. A method according to claim 1 wherein the step of introducing a flow of the liquid phase fluid into the liquid phase receiver means comprises pumping the liquid phase fluid from a liquid phase fluid source, and wherein the filling of the liquid phase receiver means develops a trigger pressure sufficient to overcome a predetermined set point pressure whereby further flow into the liquid phase receiver means is made to cease.

3. A method according to claim 2 wherein the trigger pressure also triggers the step of providing intercommunication between the gaseous receiver means and the liquid phase receiver means for substantially filling the gaseous phase fluid receiver means with gaseous phase fluid.

4. Apparatus for receiving fluid in its liquid phase and subsequently vaporizing the liquid phase fluid to produce the gaseous phase of the fluid for dispensing the gas to users, the apparatus comprising:

a manifold having a liquid receiver, a gas receiver; a liquid supply passage for connection to a liquid source to enable a flow of liquid into the liquid receiver, and including vent means having a closed state and an open state to vent the apparatus to enable the flow of liquid; a gas dispensing passage extending out of the gas receiver to enable a flow of gas out of the manifold, and an interconnecting passage providing communication between the liquid receiver and the gas receiver; and control means in the manifold having a closed state enabling liquid to flow from the liquid supply passage and into the liquid receiver, but preventing liquid from flowing into the gas receiver, the control means also having an open state in which liquid is prevented from flowing out of the liquid supply passage but enabled to flow into the liquid receiver and the gas receiver whereby there is substantially no pressure differential between the liquid receiver and the gas receiver and the liquid is enabled to vaporize in both the liquid receiver and the gas receiver and thereby provide a continuing supply of gas for dispensing to users as long as there is liquid remaining in the manifold.

5. Apparatus according to claim 4 wherein the manifold includes dispensing means in communication with the outlet of the gas dispensing passage.

6. Apparatus according to claim 4 wherein the liquid receiver comprises at least one liquid storage container having a relief valve for relieving excessive pressure in the liquid storage container, and the gas receiver comprises at least one gas storage container having a pressure gauge for determining the gas pressure in the gas storage container.

7. Apparatus according to claim 4 wherein the control means includes valve means operative in the open state of the manifold to open the liquid supply passage and close the interconnecting passage, and operative in the closed state of the manifold to close the liquid supply passage and open the interconnecting passage.

8. An apparatus according to claim 4 including pumping means for pressurizing liquid to enable flow of the liquid from the liquid source through the liquid supply passage.

9. An apparatus according to claim 4 wherein the valve means comprises a spool valve movable within the liquid supply passage.

10. An apparatus according to claim 4 wherein the valve means comprises an externally piloted three-way valve to establish the open state and the closed state.

11. An apparatus according to claim 4 wherein the apparatus is adapted to receive liquid carbon dioxide for dispensing gaseous carbon dioxide for carbonated beverages.

12. An apparatus for receiving fluid in its liquid phase and subsequently vaporizing the liquid phase fluid to produce the gaseous phase of the fluid for dispensing the gas to users, the apparatus comprising:

a manifold having an internal liquid chamber and an internal gas chamber; an interconnecting passage providing communication between the liquid chamber and the gas chamber; a liquid supply passage for connection to a liquid source to enable pumping the liquid through the liquid supply passage and into the liquid internal chamber; a liquid storage passage opening into the liquid internal chamber and adapted for connection to a liquid storage container; a gas storage passage opening into the internal gas chamber and adapted for connection to a gas storage container;

a gas dispensing passage opening into the gas chamber for coupling to a dispenser valve for dispensing gas to users;

a valve having a closed state, and including through openings providing communication in the closed state between liquid in the liquid supply passage and the liquid internal chamber, and further including downstream closure means closing communication between the internal liquid chamber and the internal gas chamber whereby a path is open for the liquid to flow from the liquid supply passage into the internal liquid chamber but not into the internal gas chamber, the valve further being movable in the liquid supply passage into an open state, the valve further including upstream closure means closing communication between the liquid supply passage and the internal liquid chamber, with the downstream closure means opening and providing communication between the internal liquid chamber and the internal gas chamber whereby there is substantially no pressure differential between the internal liquid chamber and the internal gas chamber, and the liquid is enabled to vaporize in both the internal liquid chamber and the internal gas chamber and thereby provide a continuing supply of gas for dispensing to users as long as there is liquid remaining in the manifold.

13. Apparatus according to claim 12 wherein the liquid receiver comprises at least one liquid storage container having a relief valve for relieving excessive pressure in the liquid storage container, and the gas receiver comprises at least one gas storage container having a pressure gauge for determining the gas pressure in the gas storage container.

14. Apparatus according to claim 12 wherein the control means includes valve means operative in the open state of the manifold to open the liquid supply passage and close the interconnecting passage, and operative in the closed state of the manifold to close the liquid supply passage and open the interconnecting passage.

15. An apparatus according to claim 12 including pumping means for pressurizing liquid to enable flow of the liquid from the liquid source through the liquid supply passage.

16. An apparatus according to claim 12 wherein the valve means comprises a spool valve movable within the liquid supply passage.

17. An apparatus according to claim 12 wherein the valve means comprises an externally piloted three-way valve to establish the open state and the closed state.

18. An apparatus according to claim 12 wherein the apparatus is adapted to receive liquid carbon dioxide for dispensing gaseous carbon dioxide for carbonated beverages.

19. An apparatus according to claim 12 and including bias means tending to bias the valve toward its open state in the absence of pumping of the liquid through the liquid supply passage.

20. An apparatus according to claim 19 wherein the bias means is a compression spring acting upon the downstream extremity of the valve.

* * * * *